US005172153A

United States Patent [19]

Frank et al.

[11] Patent Number: 5,172,153

[45] Date of Patent: Dec. 15, 1992

[54] PROCESSING APPARATUS

[75] Inventors: Lee F. Frank, Rochester; Jeffrey L. Helfer, Webster; Haribhajan S. Kocher, Penfield; Paul W. Wagner, Holley, both of N.Y.

[73] Assignee: Eastman Kodak Company, Rochester, N.Y.

[21] Appl. No.: 633,521

[22] Filed: Dec. 28, 1990

[51] Int. Cl.[5] ..... G03D 3/06

[52] U.S. Cl. ..... 354/322; 354/298; 354/324

[58] Field of Search ..... 354/317, 319, 320, 321, 354/322, 324, 325; 134/64 P, 122 P

[56] References Cited

U.S. PATENT DOCUMENTS

| | | | |
|---|---|---|---|
| 3,372,630 | 3/1968 | Schmidt | 95/94 |
| 3,635,144 | 1/1972 | Beck | 354/317 |
| 4,081,816 | 3/1978 | Geyken et al. | 354/324 |
| 4,719,173 | 1/1988 | Hahm | 430/398 |
| 4,804,990 | 2/1989 | Jessop | 354/324 |
| 4,922,277 | 5/1990 | Carlson et al. | 354/317 |

*Primary Examiner*—Alan A. Mathews
*Attorney, Agent, or Firm*—Frank Pincelli

[57] ABSTRACT

A web treatment apparatus comprises a means defining a channel through which the web is transported. Treatment fluid is injected into the channel on opposite sides of the web at spaced injection sites and evacuated from the channel on opposite sides of the web at spaced evacuation sites. The injection sites and evacuation sites alternate so that injected fluid is evacuated from adjacent evacuation sites. The streams of evacuated fluid are combined such that streams varying in flow path length and chemical depletion are sequentially mixed together in an ordered sequence prior to reinjection into the chemicals. In one embodiment means are also provided for sequentially dividing the fluid flow from a recirculation pump into fluid streams that are supplied to the injection sites.

16 Claims, 2 Drawing Sheets

PROCESSING APPARATUS

Cross Reference to Related Application

Reference is made to commonly assigned copending application Ser. No. 07/633,505 entitled "Apparatus for Enhancing Heat and Mass Transfer In a Fluid Medium" and filed concurrently herewith by Lee F. Frank, Jeffrey L. Helfer, Haribhajan S. Kocher and Paul W. Wagner. The disclosure of such application is incorporated herein by reference.

TECHNICAL FIELD

This invention relates to apparatus for subjecting web or sheet material to treatment and, more particularly to apparatus for processing light sensitive material such as photographic film.

BACKGROUND ART

Conventional film (or paper) processing devices do not provide a sufficient level of agitation at the film liquid interface. As a result, a layer of liquid that is depleted of reactants and enriched in reaction by products exists at the film surface. This layer is the chemical boundary layer. During photographic processing, this boundary layer can influence both the rate at which photochemicals are transferred to and from the film, as well as their concentrations within the film. Either influence can affect the rate and quality of processing.

Analysis and experimental measurements of conventional processors indicate that boundary layers exist which are thick enough so as to become the processing rate limiting parameter. More specifically, the transfer of chemical mass and heat energy through the chemical and thermal boundary layers occurs more slowly than transfer through the film itself. This condition results in low processing speeds, excessively long processing paths and increased size of the processor, including the dryer section. Also, the chemical concentrations in the processor boundary layer need to be excessively high to maintain reasonable mass transport rates resulting in inefficient utilization of the processing chemicals.

DISCLOSURE OF THE INVENTION

In commonly assigned application Ser. No. 07/633,505, cross referenced above and incorporated herein by reference, there is disclosed apparatus for minimizing the boundary layer thickness. It is an object of the present invention to combine such apparatus with a unique fluid recirculation means which provides more uniform fluid characteristics at the fluid injection sites.

In accordance with the invention, a web (in continuous or sheet form) treatment apparatus comprises a means defining a channel through which the web is transported. Treatment fluid is injected into the channel on opposite sides of the web at spaced injection sites and evacuated from the channel on opposite sides of the web at spaced evacuation sites. The injection sites and evacuation sites alternate so that injected fluid is evacuated from adjacent evacuation sites. The streams of evacuated fluid are combined such that streams varying in flow path length and chemical depletion are sequentially mixed together prior to reinjection into the channels. Such mixing results in more uniform composition of the fluid reinjected.

BRIEF DESCRIPTION OF THE DRAWINGS

Other objects and advantages will become apparent from the following description taken in connection with the accompanying drawings wherein.

MODE OF CARRYING OUT THE INVENTION

Figure 1:
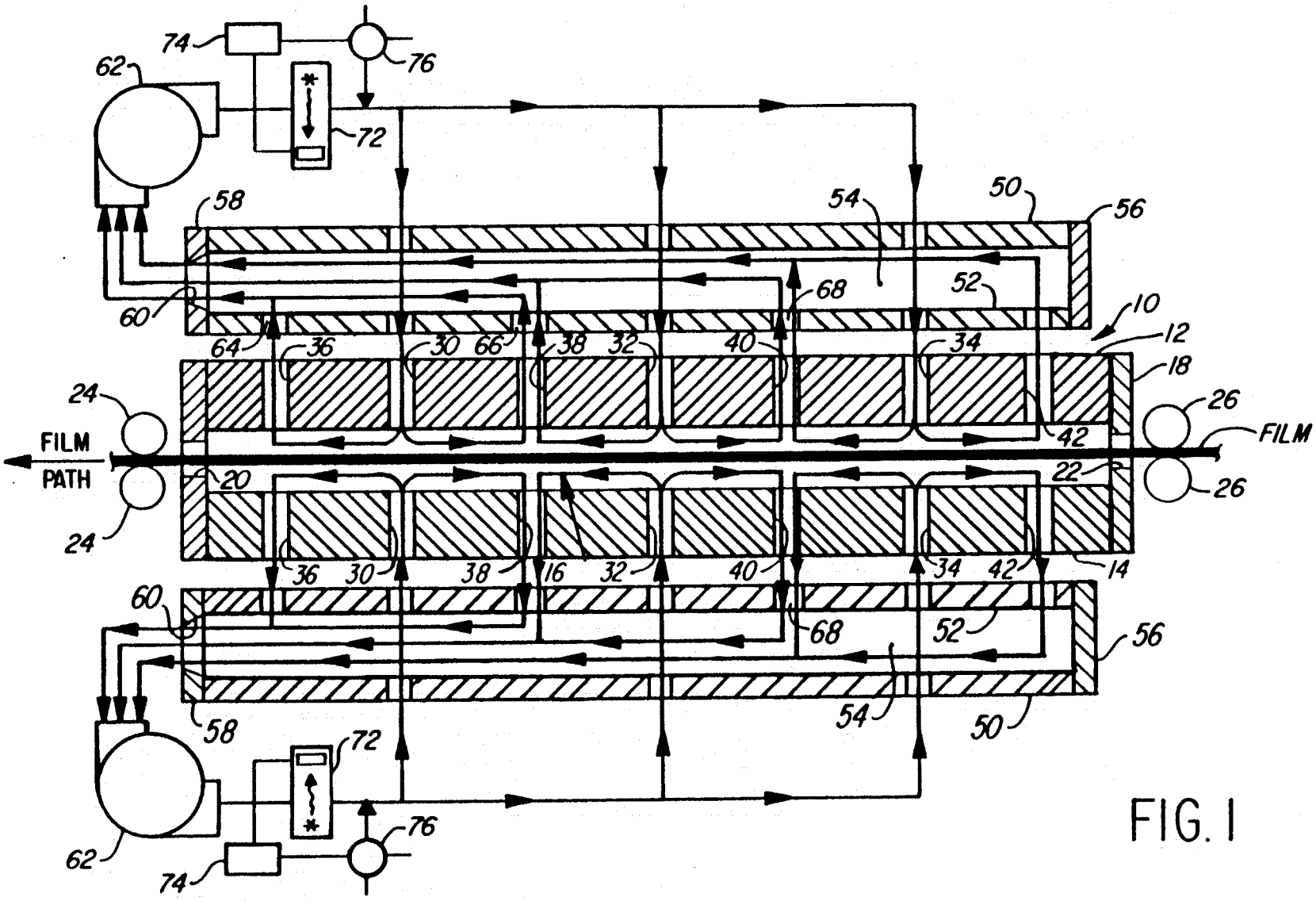
FIG. 1 is a sectional view of a preferred embodiment of a film processor in accordance with the invention with the fluid conduits depicted schematically.

While the invention will be disclosed in connection with the treatment of light sensitive materials and, specifically, photographic film, it is to be understood that the invention is applicable to treatment of photographic paper and to treatment of non-light sensitive materials where it is desirable to recirculate a treating fluid and control boundary layer thickness. The invention has particular utility where in applications where it is desired to effect rapid recirculation of fluid with effective mixing of depleted fluids while maintaining uniformity of fluid properties. It is to be understood that the term "fluid" encompasses both gaseous and liquid mediums including air and water.

Referring to the drawing, there is shown a portion of a parallel plate film processor 10 comprising a pair of spaced parallel plates 12, 14 defining an elongated fluid processing channel 16 adapted to receive a web (in continuous or sheet form) of photographic film. The plates are supported by a pair of end walls 17, 18 having slits 20, 22 respectively for the entrance and exit of the film.

The film F is transported through the channel in the direction indicated by transport means comprising two pairs of nip rollers 24, 26. One or both pairs of the nip rollers may be motor driven depending on whether the film F is in sheet or web form. If sheet film is being processed, the length of channel 16 will be less than the sheet length whereby rollers 24 will grasp the sheet before it leaves rollers 26. Also, if a liquid solution is applied to the film, the exit rollers 24 may comprise squeegee rollers to remove excess solution.

The plates 12, 14 are provided with a plurality of pairs of spaced juxtaposed injection slits 30, 32, 34 and a plurality of pairs of spaced juxtaposed evacuation slits 36, 38, 40, 42, which define injection and evacuation sites. The injection and evacuation slits extend transversely of the channel and have a length at least equal to the width of the film. The slits are placed in an alternating pattern so that each pair of juxtaposed injection slits is between two spaced pairs of juxtaposed evacuation slits with equal spacing between adjacent slits along the film path.

In operation, fluid injected into the channel 16 under pressure will form cushions of fluid under pressure on opposite sides of the film. This cushion will support the film and cause a laminar flow of fluid on each side of the film to the adjacent evacuation slits where it will be evacuated to the exterior of the processor. As disclosed in commonly assigned copending application Ser. No. 07/633,505 cross referenced above and incorporated herein by reference, the spacing between adjacent slits is selected to cause evacuation of the flowing fluid when its boundary layer becomes thick enough to render the treatment of the film inefficient. Such conditions are more fully described in that application and further description herein deemed unnecessary.

The recirculation and replenishment system is illustrated by lines and arrows in the drawing for clarity. Arrangements of suitable piping to accomplish the flow and mixing indicated is within the capability of one skilled in the arts of fluid mechanics and plumbing and further disclosure is deemed unnecessary. Also, the fluid circulation and mixing system on the upper and lower sides of the film are identical and only the upper system will be described in detail.

Referring to the drawing, the recirculation system includes a mixing means comprising a pair of spaced parallel plates 50 and 52 defining an elongated mixing chamber 54. The plates 50 and 52 may be supported by end plates 56 and 58. Alternatively, plates 50 and 52 and one of the end plates may be formed as an integral molded housing and the other end plate attached to such structure.

The end plate 58 may be provided with elongated funnel-like outlet fitting 60 which is coupled to a recirculation pump 62. The plate 52 is provided with a plurality of inlet ports 64, 66, 68, 70 connected with the evacuation ports 36, 38, 40, 42 respectively by suitable plumbing as indicated schematically. The pump 62 is connected by suitable plumbing and/or manifolds to the injection ports 30, 32, 34 and 36 as indicated schematically. At the outlet of the pump, a sensor 72 may be provided to determine the condition of the fluid being recirculated. A control means 74 responsive to the output of the sensor may be arranged to open a replenishment valve 76 when the fluid condition in such as to require mixture with fresh solution. Alternatively, the fluid may be discarded or treated to remove undesirable byproducts, such as to minimize environmental discharges.

In operation of the mixing system, it will be noted that a portion of the fluid injected at port 34 will be evacuated at port 42, the port most remote from the outlet 60 of the mixing chamber. Since this fluid stream treated the leading end of the film, it is most depleted in chemistry. The injection into the mixing chamber at the end remote from the outlet gives this stream the entire length of the mixing chamber to mix with less depleted fluid streams.

The other portion of the fluid injected at port 34 and a portion of the stream injected at port 32 will be evacuated through port 40 and enter the mixing chamber at port 68, the second most remote port from the chamber outlet. These two streams will mix together in ports 40 and 68 prior to entering the chamber and the combined stream then will mix with the fluid evacuated at port 42. Thus. in the region of the mixing chamber adjacent port 68, three streams will essentially have been mixed, all of which originally differed in chemical depletion. These streams will also differ in time phasing with respect to injection into and evacuation from the processor resulting from the different flow path lengths from the pump to the injection ports. This difference in time phasing will also augment the mixing action.

The sequential mixing action will continue as the mixed stream flows toward the outlet 60. At port 66, a mixed stream containing portions of the fluid streams injected at ports 32 and 30 will enter the chamber and mix with fluid stream comprised of fluids from ports 68 and 70. This further combined mixed fluid stream will mix with the remainder of the stream injected at port 30 in the region of port 64. Thus, the fluid discharged at the outlet of the chamber will be thoroughly mixed and substantially uniform in composition.

It will also be apparent that mixing occurs in all parts of the system including the pump 62 the inlet ports to the mixing chamber, and the injection and evacuation ports. The apparatus thus comprises a closed loop processing system in which essentially all of the fluids are mixed and recirculated very frequently. Most importantly all fluids pass through a single region (the pump) which enhances the mixing before the fluid is redistributed. The high agitation within the pump insures complete mixing.

The advantages of the mixing process will now be apparent. The most chemically depleted fluid streams are sequentially injected into the mixing chamber at points progressively spaced in order of depletion with the most depleted streams injected at the end most remote from the outlet and the least depleted stream injected closest to the outlet. In addition, adjacent streams are combined in the evacuation ports prior to injection into the mixing chamber to enhance the mixing process. The mixing is further enhanced by the different lead times of the fluid streams. For example, changes in the chemical concentration of fluids in the short flow paths having varying chemical concentrations are rapidly mixed with fluids in the medium and long flow paths. Similarly, the addition of chemical replenishment in the shorter path (exit of pump 62) is rapidly disseminated to the other longer paths. These features result in a highly ordered sequential mixing process with outstanding solution uniformity. Also, the mixing occurs without the use of moving parts.

An apparatus incorporating the concepts disclosed herein is capable of achieving total solution turnover every 5–10 seconds. By comparison, a typical roller transport deep tank processor has stagnant regions which contain fluid that is turned over or recirculated only every 5–20 minutes. This comparison indicates the superior performance that is achieved with the closed loop mixing process in accordance with the invention.

Figure 2:
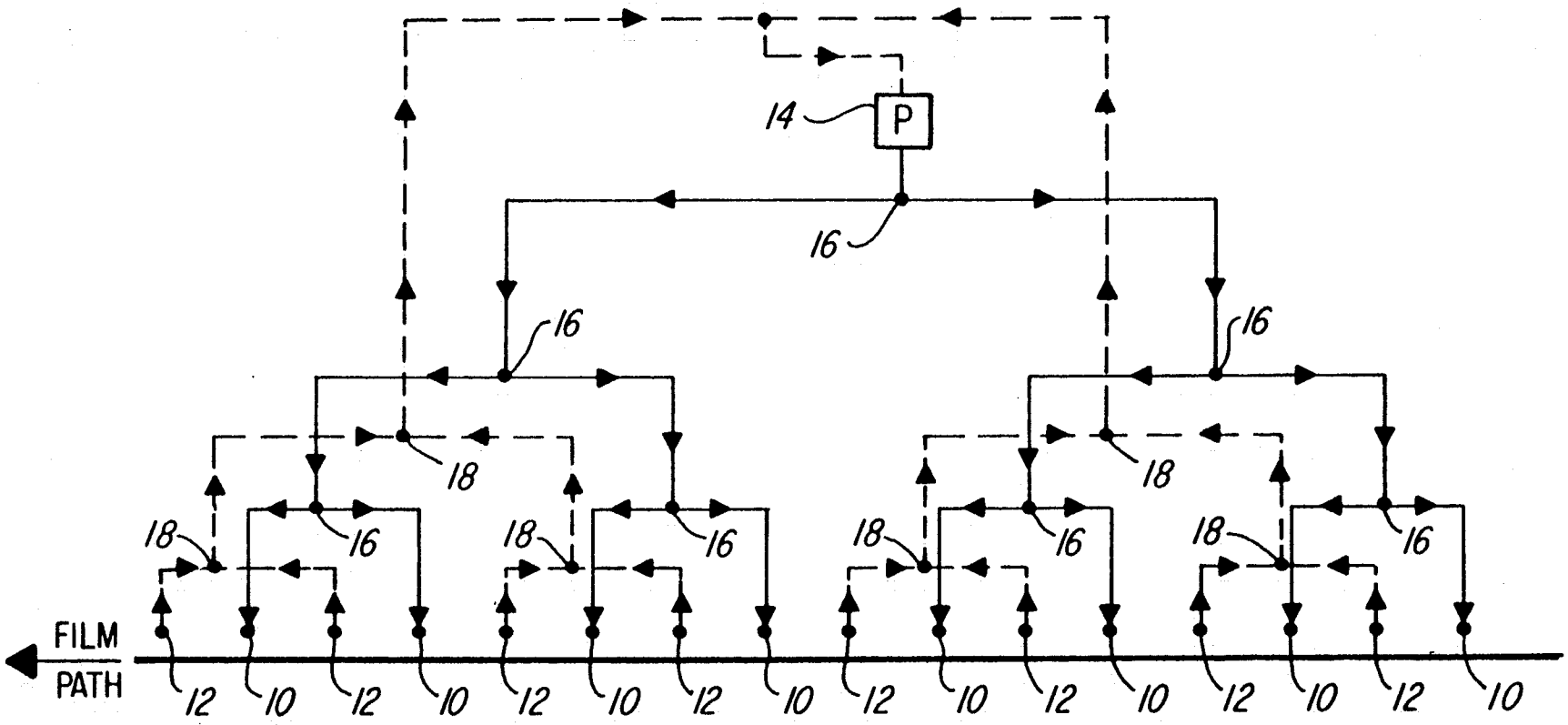
FIG. 2 is a schematic illustration of another embodiment of the invention.

Referring to FIG. 2 of the drawings there is shown another embodiment of a closed loop mixing system in accordance with the invention. This embodiment would also include a pair of parallel plates similar to the FIG. 1 embodiment and would also have spaced slits in the plates to define a plurality of injection sites 10 and a plurality of evacuation sites 12, the sites alternating as in the case of the FIG. 1 embodiment so that an injection site is located between adjacent evacuation sites. The spacing between the sites is selected to cause evacuation of the flowing fluid when its boundary layer becomes thick enough to render the treatment of the film inefficient.

The plumbing for the system shown in FIG. 2 is indicated schematically to clarify the operation of the invention. It will be obvious, however, that arrangements of suitable manifolds and plumbing to accomplish the circulation indicated are within the capabilities of one skilled in the arts of fluid mechanics and plumbing. It is also to be understood that in the case of the FIG. 1 embodiment, the systems on each side of the film are identical with juxtaposed injection and evacuation slits. According only the system on the upper side of the film is shown and described.

Referring now to the circulation system the solid lines represent the flow paths of fluid from the pump 14 to the injection sites 10 and the dashed lines represent the flow paths of fluid from the evacuation sites to the inlet of the pump. In the injection system it will be noted that the output of the pump is uniformly and sequentially divided at node or branch points 16 and that the evacuated fluid is uniformly and sequentially combined at nodal branch points 18. In the evacuation system all fluids are progressively mixed after contacting the film or paper. Also, all fluids pass through a single region (the pump) before being circulated. The high agitation within the pump assures that the fluid streams are completely mixed and the branch points or nodes provide sequential mixing of streams varying in chemical depletion and time phasing prior to entering the pump.

Those skilled in the art to which the invention relates will appreciate that various substitutions and modifications can be made to the described embodiment without departing from the spirit and scope of the invention as described by the claims below.

What is claimed is:

1. Apparatus for treating a moving web with a fluid, said apparatus comprising:

means defining an elongated channel having an entrance for receiving the web and an exit for exiting the web;

means for injecting the treating fluid into said channel at a plurality of sites spaced along the length of said channel in a predetermined progression from said entrance to said exit;

means for evacuating treating fluid from said channel at a plurality of spaced sites along the length of said channel in a predetermined progression from said entrance to said exit;

means defining an elongated mixing chamber adjacent said channel; and means for injecting fluid from said evacuation sites into said mixing chamber along the length of said chamber in a predetermined sequence whereby evacuated treatment fluids differing in treatment capability is introduced into said chamber in an ordered sequence; and means for circulating treatment fluid from said chamber to said injection sites.

2. Apparatus as claimed in claim 1, wherein fluid most depleted in treatment capability are introduced into said mixing chamber at sites furthest from said outlet.

3. Apparatus as claimed in claims 1 or 2, wherein fluids having differing flow path lengths are sequentially introduced into said mixing chamber.

4. Apparatus as claimed in claim 3, wherein said evacuation sites alternate with said injection sites whereby each injection site is located between two evacuation sites and fluid flows from each injection site to the two adjacent evacuation sites.

5. Apparatus as claimed in claim 4, wherein each injection site is spaced from each adjacent evacuation site by a distance such that the fluid is evacuated when its boundary layer reaches a predetermined thickness.

6. Apparatus as claimed in claim 5, wherein each of said sites in said mixing chamber correspond in number to said evacuation sites in said channel, said evacuation sites communicating with said mixing chamber sites whereby the progression of evacuation sites from said entrance communicate with the progression of mixing chamber sites from said outlet respectively.

7. Apparatus for chemically treating light sensitive web or sheet material with a fluid during processing, said apparatus comprising:

means defining an elongated treatment channel having an entrance at one end for receiving the web and an exit at the opposite end for exiting the web;

means for transporting the web through said channel from said entrance to said exit;

means for injecting treatment fluid into said channel at a plurality of sites along the length of said channel;

means for evacuating treatment fluid from said channel at a plurality of spaced sites along the length of said channel;

means defining an elongated mixing chamber for mixing evacuated fluid prior to recirculation, said chamber having an outlet and a plurality of spaced fluid inlet sites along the length of said chamber communicating with said injection sites respectively, said inlet sites in progression from said outlet communicating with the evacuation sites in progression from said exit whereby the most chemically depleted treatment fluid enter said mixing chamber at sites spaced further from said outlet than the less chemically depleted fluid; and means for circulating fluid from said mixing chamber outlet to said injection sites.

8. Apparatus as claimed in claim 7, wherein fluids differing in flow path length are sequentially introduced into said chamber.

9. Apparatus as claimed in claim 8, wherein said injection and evacuation sites are equally spaced along said channel and said injection sites alternate with said evacuation sites so that each injection site is between two adjacent evacuation sites.

10. Apparatus as claimed in claim 9, wherein said injection means and said evacuation means each comprises a plurality of pairs of spaced juxtaposed ports on opposite sides of the web.

11. Apparatus as claimed in claim 10, wherein each of said evacuation ports and each of said injection ports comprise elongated openings extending transversely of said channel.

12. Apparatus as claimed in claim 11, wherein said channel defining means comprises a pair of elongated plates having a predetermined space therebetween to define said channel, said elongated openings comprising slits in said plates.

13. Apparatus as claimed in claim 12 further comprising:

means for sensing the effectiveness of the solutions between said mixing tank and said injection ports; and means for replenishing portions of the solution with fresh solution in response to sensing of a particular threshold of ineffectiveness.

14. Apparatus for treating a moving web with a fluid, said apparatus comprising:

means defining an elongated channel for receiving the web;

means for injecting the treating fluid into said channel at a plurality of sites spaced along the length of said channel;

means for evacuating treating fluid from said channel at a plurality of sites spaced along the length of said channel;

pump means having an inlet and outlet for circulating fluid from said evacuation sites to said injection sites; and means between said evacuation sites and said inlet for sequentially combining fluid evacuated at said evacuation sites at predetermined nodal points to provide uniform combining and mixing of the evacuated fluids between the evacuation sites and the pump inlet.

15. Apparatus as claimed in claim 14 further including means between said outlet and said injection sites for uniformly and sequentially dividing the fluid from the pump into fluid streams that are supplied to said injection sites.

16. Apparatus as claimed in claim 15 wherein said means between said outlet and said injection sites sequentially divides fluid from the pump into fluid streams at second predetermined nodal points.

* * * * *